US005575012A

United States Patent [19]

Fox et al.

[11] Patent Number: 5,575,012

[45] Date of Patent: Nov. 19, 1996

[54] METHOD FOR TREATING LEGWEAR AND PRODUCT

[76] Inventors: Maurice Fox, 1 Windgate Dr., New City, N.Y. 10956; Selwyn P. Schenkman, 2 Elath Rd., New City, N.Y. 10956; Stanley Selman, 1902 Fain Cemetery Rd., Dandridge, Tenn. 37725

[21] Appl. No.: 285,128

[22] Filed: Aug. 2, 1994

Related U.S. Application Data

[63] Continuation-in-part of Ser. No. 61,455, May 17, 1993, abandoned.

[51] Int. Cl.[6] ..... A41B 11/00

[52] U.S. Cl. ..... 2/239; 2/409; 427/389.9

[58] Field of Search ..... 2/239, 409, 904, 2/902, 69, 243.1, 168, 243; 36/138, 44; 66/178 R; 139/408; 28/100, 140, 143, 153, 154, 165, 167, 169; 427/389.9, 393.1, 393.4; 428/264, 265, 270, 421, 422

[56] References Cited

U.S. PATENT DOCUMENTS

| | | | |
|---|---|---|---|
| 3,749,138 | 7/1973 | Rheaume et al. | 139/408 |
| 4,152,784 | 5/1979 | McGalliard . | |
| 4,261,061 | 4/1981 | McAlvage | 2/239 |
| 4,296,499 | 10/1981 | Patterson et al. | 2/239 |
| 4,550,446 | 11/1985 | Herman | 2/239 |
| 4,805,240 | 2/1989 | Siqveland | 2/54 |
| 4,967,494 | 11/1990 | Johnson | 2/239 |
| 5,154,682 | 10/1992 | Kellerman | 36/44 |

FOREIGN PATENT DOCUMENTS

| | | |
|---|---|---|
| 2007860 | 9/1971 | Germany . |
| 820793 | 11/1979 | Germany . |
| 3534-401 | 4/1987 | Germany . |
| 5-5062-201 | 10/1976 | Japan . |
| 17275 | 6/1898 | United Kingdom . |

OTHER PUBLICATIONS

*Friction Blisters and Sock Fiber Composition,* K. Herring et al, Journal of the American Podiatric Medical Association, V. 80, No. 2, Feb. 1990, pp. 63–71.

*Comparison of Cotton and Acrylic Socks Using a Generic Cushion Sole Design for Runners,* K. Herring et al, Journal of the American Podiatric Medical Association, V. 83, No. 9, Sep. 1993, pp. 515–522.

*Teflon® PTFE Price List,* Effective Feb. 1, 1991, one page.

*Teflon®PTFE 30—Product Information,* undated, three pages.

*Primary Examiner*—C. D. Crowder
*Assistant Examiner*—Gloria Hale
*Attorney, Agent, or Firm*—Francis T. Coppa

[57] ABSTRACT

A sock which provides increased comfort to the wearer as a result of reduced friction between the sock and the foot. The reduced friction is accomplished by treating the sock with a fluoropolymer. The treated sock contains discrete fluoropolymer particles (in non-membranous form) on or near the surface which contacts the foot. The treatment can by carried out by spraying, dipping, impregnating, coating of precursor fibers, or other conventional coating methods.

23 Claims, No Drawings

METHOD FOR TREATING LEGWEAR AND PRODUCT

This application is a continuation-in-part application of Ser. No. 08/061,455 for Maurice Fox et al, filed May 17, 1993, now abandoned, which is hereby incorporated by reference.

BACKGROUND OF THE INVENTION

This invention relates to improved comfort of the foot while engaging in both normal everyday activities and sporting activities. More particularly, it relates to socks and stockings made of natural or synthetic fibers, Which have been treated with a fluoropolymer to reduce friction between the foot and the sock or stocking. (Throughout this application, the term "sock" is defined to include all types of socks and stockings).

While the underlying cause of discomfort of the foot may be poorly fitting shoes, physical abnormality of the foot, shoes, etc., the direct cause of the discomfort is irritation caused by friction between the foot and the sock. Previous attempts in the art attempted to reduce this friction in athletic socks, for people engaged in sports activities, by treating the exterior of the sock with a mild lubricant such as a soap or a lubricating jelly. This approach has three deficiencies: the effectiveness of the lubricant is decreased by the presence of moisture and perspiration; the treatment is not permanent and must be repeated each time the sock is worn; and the lubricant is not at the actual site of the problem, which is the interface between the foot and the sock. The moisture sensitivity of the lubricants described in the art prevents them from being used at this interface.

SUMMARY OF THE INVENTION

Briefly stated, the present invention embraces a process and product to increase comfort by reducing friction between the foot and a sock. The reduced friction leads to a more comfortable feeling, and should reduce the incidence of friction-induced foot problems, such as irritation leading to blisters, tylosis, and digital helomata.

According to the invention, socks are treated with a fluoropolymer which is highly stable, inert to moisture and chemicals or medicines that might be used on the foot, and does not noticeably change any of the characteristics of the sock, other than lubricity. The treated sock contains discrete fluoropolymer particles (in non-membranous form) on or near the surface which contacts the foot, resulting in reduced friction and increased comfort. The fluoropolymer particles are incorporated into the sock, and are not removed by repeated wear and washing.

DETAILED DESCRIPTION OF THE INVENTION

Many fluoropolymers may be utilized in this invention; some are mentioned in the following examples. The preferred material is polytetrafluoroethylene (PTFE). A commercial example of this type of polymer is the Teflon® product, available from E. I. Dupont Company. Other suitable fluoropolymer-containing products are available from 3M Corporation, Borden Company, and Dupont.

In general, the technique for treating the sock with the fluoropolymer is not critical. Thus, treatment can be carried out by dipping the sock into a composition containing the fluoropolymer, or coating the sock with such a composition, e.g., by brushing or rolling. The "composition" in these cases is usually an aqueous dispersion of the fluoropolymer, which may also contain one or more other additives, such as wetting agents and stabilizers.

Treatment can also be carried out by spraying the sock with a composition containing the fluoropolymer, e.g., an aerosol spray, which usually employs some type of organic carrier. Alternatively, an aqueous dispersion of the fluoropolymer can be sprayed onto the sock.

In some embodiments, dipping the sock in an aqueous dispersion of the fluoropolymer appears to be most effective. This technique appears to very sufficiently incorporate the fluoropolymer into the sock, and can also be adapted in a commercial environment, i.e., during the manufacturing of the socks. As an example, the dispersion could be utilized in the final washing step which is frequently undertaken in making socks.

The amount of fluoropolymer employed is not especially critical, since small levels of the material are often effective. For the sake of convenience, the amount employed is described here in terms of that which is contained on or within the fabric of the sock after treatment is complete. In general, the level of fluoropolymer is in the range of about 0.1% by weight to about 30% by weight, based on the combined weight of the fluoropolymer and the portion of an average sock which extends from the bottom of the ankle to the tip of the large toe (i.e., the portion of the sock which actually contacts the foot). The weight of an average sock (based on an adult male with a shoe size in the range of 8 to 12) will of course depend on the materials from which it is made. For most types of average socks, the portion contacting the foot will have a weight in the range of about 5 grams to about 40 grams.

Within the above-mentioned range, lower levels of fluoropolymer are often preferred, since higher levels will result in higher costs, and sometimes make the sock stiffer and less supple. A preferred level of fluoropolymer is in the range of about 1% by weight to about 15% by weight, while an especially preferred level is in the range of about 2% by weight to about 8% by weight. Those of ordinary skill will be able to select the most appropriate range without undue experimentation, based on the examples herein, the type of sock, the type of fluoropolymer, and the like.

The amount of fluoropolymer incorporated into the sock during the treatment can be controlled by varying the concentration of fluoropolymer in the treatment composition, and/or by varying the amount of treatment composition left in the sock before drying. For example, when the sock is treated by dipping in an aqueous dispersion having a known concentration of fluoropolymer, it can be weighed, before and after dipping, to determine how much fluoropolymer has been retained by the sock. If the amount is higher than desired, the sock can be wrung to decrease the retained amount of fluoropolymer. The amount of fluoropolymer retained by the dried sock after completion of the treatment can be confirmed by weighing the dried sock.

Treatment times are also not especially critical, and are based in part on the time necessary to incorporate the desired level of fluoropolymer in the sock. In the case of immersion of the sock in the aqueous dispersion, for example, only about 1 to 15 seconds is necessary. Again, those skilled in the art can easily select the most appropriate treatment time, based on the factors outlined herein.

A sock treated according to this invention contains individual particles of the fluoropolymer. It appears that some of the particles rest on or near the surface. Other particles are below the surface, and appear to be mechanically entrapped within the fibers or yarn which is woven to form the sock. This generally discontinuous arrangement of fluoropolymer particles is to be contrasted with any types of fluoropolymer membranes, layers, or coatings, which are continuous types of structures. As an example, a coating of a Teflon® material on an item of cookware must be prepared under high temperature conditions (e.g., above about 350° C.) which cause the Teflon® particles to adhere to each other. Such conditions are not part of the present invention, since treatment here can be carried out at or near room temperature.

Socks treated according to this invention retain their lubricity-characteristics after repeated wearing and washing. This represents a distinct advantage over prior art attempts to alter the characteristics of socks, e.g., the use of water-soluble additives which are washed out of the socks, necessitating repeated treatments.

In an alternative embodiment, treatment with the fluoropolymer can be carried out before the socks are made. As an example, the individual fibers which are spun into yam could be dipped into a dispersion of the fluoropolymer. Similarly, the yarn itself could be treated, prior to the knitting process used to make the sock. Textile and knitting processes are known in the art and need not be dealt with in detail here. As an example, relevant processes are described in the following references: *The Encyclopedia Americana*, International Edition, 1989 Grolier Incorporated, Vol. 26, pp. 566–582; *The Encyclopedia Americana*, International Edition, 1964, Americana Corporation, Vol. 14, pp. 424–426; Vol. 16, pp. 488–490; and Vol. 26, pp. 467b–481. The contents of each of these texts are incorporated herein by reference. It is expected that these socks would generally exhibit the same lubricity characteristics as those treated after manufacture.

The choice of material used to make socks treated according to this invention is not critical. The socks can be formed from synthetic fibers, natural fibers, or any mixture of fibers typically used in the hosiery industry. Nonlimiting examples of suitable materials include nylon, acrylic, cotton, and blends or mixtures of any of the foregoing.

The following examples are provided to more fully describe this invention. They should be considered as illustrative of the invention, rather than limiting what is otherwise disclosed and claimed herein. All parts and percentages are by weight, unless otherwise specified.

EXAMPLES 1–4

In each of the following examples, treatment of the socks based on this invention was carried out by applying a fluoropolymer to the part of the sock that contacts the foot to substantially reduce friction and increase comfort to the wearer.

EXAMPLE 1

A group of new socks was treated by dipping in an aqueous dispersion of Zepel® product, and then allowing them to dry at room temperature.

EXAMPLE 2

Another group of new socks was treated with Teflon® material by spraying them with an aerosol spray of Elmer's Slide-All®, a product of Borden Company. The major ingredient in Slide-All® product is Teflon® polymer.

EXAMPLE 3

A third group of new socks was treated with Scotchgard® fabric protector applied as an aerosol spray.

EXAMPLE 4

A fourth group of new socks was treated with heavy-duty Scotchgard® protector, applied as an aerosol spray.

Wear Test Procedure

Six test participants were each provided with a pair of socks. One sock in the pair was treated in accordance with Examples 1 through 4, and the other sock was not treated. The participant in the test did not know which sock had been treated. Each of the participants wore the socks for several hours while going about normal activities. They were then asked which sock felt more comfortable, and why. In each case the participant selected the treated sock as being more comfortable. The details of the tests are presented below.

Results of the Wear Tests

The first participant wore socks made from a blend of acrylic and nylon fibers, with one of the socks treated according to Example 2. She wore the socks for a period of nine hours with suede boots, and did considerable walking during this period. She indicated that she was hardly aware of the presence of the treated sock, while she could feel the presence of the untreated sock.

The second participant wore socks made from a blend of bulk acrylic, stretch nylon, and Spandex material, with one of the socks treated according to Example 2. She walked two miles wearing sneakers during one and a half hours, and reported that the treated sock was substantially more comfortable because it was more slippery and cooler.

The third participant wore stockings of 100% nylon, with one of the stockings treated in accordance with Example 1. She wore leather sport sneakers, and did considerable walking over a period of six hours. She reported that the treated stocking was more comfortable, as it imparted a smoother feeling than the untreated stocking.

The fourth participant wore socks of 100% cotton, with one of the socks treated in accordance with Example 2. She wore the socks for a period of five hours, and reported that the treated sock felt more dry and comfortable than the untreated sock.

The fifth and sixth participants wore 100% nylon stockings, with one of the stockings treated in accordance with Example 3 in one case, and Example 4 in the other case. Both participants wore the stockings for a period of five hours, and each reported that the treated stocking was more comfortable, in that it was more slippery, and there was no feeling of wearing a stocking.

It should be noted that in each case, the product of this invention provided improved comfort to the wearer as a result of the increased sensation of lubricity. Fluoropolymers have low coefficients of friction, and impart this property to the sock. Fluoropolymers are chemically inert, and therefore the lubricity was not adversely affected by the moisture generated during extended wear periods and heavy activity of the wearer.

EXAMPLE 5

In this example, the friction characteristics of socks treated according to this invention are measured and compared with those left untreated. The treatment agents were as follows:

T3170: Teflon® TE-3170, a small particle size PTFE fluorocarbon resin dispersion made by E. I. Dupont Co. The average particle size is less than 0.185 micron.

T30: Teflon® 30, which is a standard particle size PTFE fluorocarbon resin dispersion available from E. I. Dupont. The average particle size is 0.22 micron.

Classical Method were repeated five times on each sample to determine mean value. Tests using the Kawabata method were repeated six times: three times forward and three times back.

The results are shown in Table 1:

TABLE 1

| Sample # | Test Method | Sock Surface | Fluoropolymer Conc. and Type[a] | C.o.F.[b] Untreated | C.o.F.[b] Treated | Change (%) |
|---|---|---|---|---|---|---|
| 1 | I.P.[c] | Flat | 10% T3170 | 0.48 | 0.46 | −4% |
| 2 | I.P. | Flat | 29% T3170 | 0.48 | 0.44 | −8% |
| 3 | I.P. | Flat | 2.6% T3170 | 0.48 | 0.43 | −10% |
| 4 | I.P. | Flat | 8% T30 | 0.48 | 0.46 | −4% |
| 5 | Kawabata | Flat | 10% T3170 | 0.54 | 0.51 | −5% |
| 6 | I.P. | Terry | 10% T3170 | 0.43/0.41[d] | 0.52 | +24% |
| 7 | I.P. | Terry | 29% T3170 | 0.43/0.41[d] | 0.38 | −10% |
| 8 | I.P. | Terry | 2.6% T3170 | 0.43/0.41[d] | 0.43 | +2% |
| 9 | I.P. | Terry | 8% T30 | 0.43/0.41[d] | 0.33 | −21% |
| 10 | Kawabata | Terry | 10% T3170 | 0.55 | 0.52 | −5% |

[a]T3170 = Teflon ® TE-3170; T30 = Teflon ® 30; levels are based on the total solids weight of the Teflon ® material as a percentage of combined weight of the sock and the Teflon ® solids.
[b]C.o.F. = Coefficient of Friction
[c]I.P. = Classical Inclined Plane and Weight Method
[d]Results measured on two different occasions; average used in calculating change.

Each of the Teflon® dispersions also contained a wetting agent.

Each of these treatment agents was used in the form of an aqueous dispersion (see the table).

Identical socks were used for each sample: "Ridgeview CoolMax X-Training Crew", model R45025. The sock has a fiber content of 80% "CoolMax", 15% stretch nylon, and 5% elastic. The socks were treated in a consistent manner by immersion for 5 to 15 seconds in the PTFE dispersions listed in the table. The socks were then removed from the dispersion, mildly squeezed to remove excess dispersion, and dried. The socks were then washed to remove the wetting agent, and again dried. Untreated socks were washed and dried in an identical manner, and were used as controls. All socks were converted to flat samples for testing in the same manner. One side of each sample was the "rib" side, which is relatively flat. The opposite surface was the pile or "terry" side, which was considerably rougher (the terry side is the inside of the sock that normally contacts the foot).

Two different tests were utilized in the determination of the coefficient of friction:

(1) Classical Inclined Plane and Weight Method: This test measures coefficient of friction via a determination of the angle at which the test sample, weighted down in a standard manner, slides down an inclined plane. The test is generally described in *Principles of Physics*, by J. B. Marion et al, chapter 7–1, Saunders College Publishing, New York, N.Y., 1984.

(2) Kawabata Method: This test is described in *Standardization Analysis of Hand Evaluation*, by Sueo Kawabata; July, 1980, 2nd Edition, pp 31–35, 48–50. As compared to the Classical Method, the Kawabata test is more reliable for measuring the coefficient of friction on rough surfaces. In this method, the test material is moved from left to right while a contacting element (of specific dimensions, and under constant force) touches the surface of the material. A transducer connected to the detector is used to measure frictional force as the test material is moved.

The coefficient of friction was determined on both the rib side and the terry side of the samples. Tests using the The above results clearly demonstrate that socks treated according to the present invention exhibit reduced friction characteristics as compared to their untreated counterparts. Although the results of the Classical Inclined Plane test for the rougher, terry side of the socks were inconsistent, the more reliable Kawabata test demonstrated reduced friction for sample 10. Since friction is the fundamental cause of foot irritation and blister formation, it appears clear that the reductions in C.o.F. set forth in Table 1 will provide an increased level of comfort.

Table 1 also demonstrates that in some instances, relatively low levels of the treatment agent (e.g., sample 3) were effective in significantly reducing the C.o.F. As mentioned above, the use of lower levels is often desirable in view of costs, and in view of the tendency for socks with high levels of the agent to sometimes become stiff.

Furthermore, the effectiveness of sock treatment according to the present invention is maintained after repeated wear and washing of the sock.

Other modifications and variations of this invention are possible in view of the description thus provided. It should be understood, therefore, that changes may be made in the particular embodiments shown which are within the scope of the invention defined in the appended claims.

All of the patents or other references mentioned above are incorporated herein by reference.

We claim:

1. A sock for wearing upon a foot, wherein the surface of the sock which contacts the skin of the foot comprises discrete, individual particles of a fluoropolymer, and wherein the amount of fluoropolymer contained on the sock surface and in the fabric of the sock is sufficient to reduce friction between the foot and the sock.

2. The sock of claim 1, wherein the fluoropolymer is polytetrafluoroethylene.

3. The sock of claim 1, wherein the amount of fluoropolymer contained on the surface and in the fabric of the sock is in the range of about 0.1% by weight to about 30% by weight, based on the combined weight of the fluoropolymer and the portion of an average sock which extends from the bottom of the ankle to the tip of the large toe.

4. The sock of claim 3, wherein the amount of fluoropolymer contained on the surface and in the fabric of the sock is in the range of about 1% by weight to about 15% by weight.

5. The sock of claim 4, wherein the amount of fluoropolymer contained on the surface and in the fabric of the sock is in the range of about 2% by weight to about 8% by weight.

6. The sock of claim 1, wherein the fluoropolymer particles are incorporated into the sock by contacting the sock with an aqueous dispersion of the fluoropolymer.

7. The sock of claim 6, wherein the aqueous dispersion further comprises at least one ingredient selected from the group consisting of a wetting agent and a stabilizer.

8. The sock of claim 1, wherein the fluoropolymer particles are incorporated into the sock by dipping the sock in a dispersion which comprises the fluoropolymer.

9. The sock of claim 1, wherein the fluoropolymer particles are incorporated into the sock by coating the sock with a dispersion which comprises the fluoropolymer.

10. The sock of claim 1, wherein the fluoropolymer particles are incorporated into the sock by spraying a composition comprising the fluoropolymer onto the surface of the sock.

11. The sock of claim 10, wherein the composition is an aqueous dispersion.

12. The sock of claim 1, prepared from at least one material selected from the group consisting of synthetic fibers, natural fibers, and mixtures thereof.

13. The sock of claim 12 prepared from at least one material selected from the group consisting of nylon, acrylic, cotton, and mixtures thereof.

14. The sock of claim 1, wherein the arrangement of individual fluoropolymer particles is generally discontinuous.

15. The sock of claim 1, wherein the fluoropolymer particles are highly stable and inert to moisture.

16. A method for improving the comfort of socks comprising the steps of (a) providing a sock; (b) treating the sock with a fluoropolymer, such that the surface of the sock which contacts the skin of the foot comprises discrete, individual, particles of the fluoropolymer.

17. The method of claim 16, wherein the fluoropolymer is polytetrafluoroethylene.

18. The method of claim 16, wherein the mount of fluoropolymer contained on the surface and in the fabric of the sock is in the range of about 0.1% by weight to about 30% by weight, based on the combined weight of the fluoropolymer and the portion of an average sock which extends from the bottom of the ankle to the tip of the large toe.

19. The method of claim 16, wherein treatment is carried out by contacting the sock with an aqueous dispersion of the fluoropolymer.

20. The method of claim 19, wherein treatment is carried out by dipping the sock in a dispersion which comprises the fluoropolymer.

21. A method for manufacturing a sock with improved comfort characteristics, for wearing upon a foot, comprising the steps of:

(a) treating yarn with a fluoropolymer, such that the yarn comprises individual particles of the fluoropolymer; and (b) knitting the yarn into a sock wherein the surface of the sock which contacts the skin of the foot comprises individual particles of the fluoropolymer.

22. The method of claim 21, wherein the fluoropolymer is polytetrafluoroethylene.

23. A method for manufacturing a sock with improved comfort characteristics, for wearing upon a foot, comprising the steps of:

(a) treating fibers with a fluoropolymer, such that the fibers comprise individual particles of the fluoropolymer;

(b) spinning the treated fibers into yarn; and (c) knitting the yarn in to a sock wherein the surface of the sock which contacts the skin of the foot comprises individual particles of the fluoropolymer.

* * * * *